US008516655B2

(12) United States Patent
Maurer et al.

(10) Patent No.: US 8,516,655 B2
(45) Date of Patent: Aug. 27, 2013

(54) VACUUM CLEANER WITH ELECTRONIC AGITATOR CONTROL

(75) Inventors: Edgar A. Maurer, Canton, OH (US); Jack S. Stayer, Jr., Greentown, OH (US); Evan A. Gordon, Canton, OH (US)

(73) Assignee: Techtronic Floor Care Technology Limited, Tortola (VG)

( * ) Notice: Subject to any disclaimer, the term of this patent is extended or adjusted under 35 U.S.C. 154(b) by 1129 days.

(21) Appl. No.: 11/799,971

(22) Filed: May 3, 2007

(65) Prior Publication Data

US 2008/0271285 A1 Nov. 6, 2008

(51) Int. Cl.
*A47L 5/34* (2006.01)

(52) U.S. Cl.
USPC ..... 15/391; 15/354; 15/355; 15/390

(58) Field of Classification Search
USPC ..... 15/389–391, 354, 332, 333, 355, 15/356, 361
See application file for complete search history.

(56) References Cited

U.S. PATENT DOCUMENTS

| | | | | |
|---|---|---|---|---|
| 3,581,591 | A | 6/1971 | Ziegler et al. | |
| 3,618,687 | A | 11/1971 | Ripple et al. | |
| 4,380,846 | A * | 4/1983 | Maurer | 15/391 |
| 5,176,581 | A | 1/1993 | Kumm | |
| 5,339,916 | A | 8/1994 | Louis | |
| 5,537,712 | A * | 7/1996 | Weber et al. | 15/391 |
| 6,067,689 | A * | 5/2000 | Roney et al. | 15/390 |
| 6,098,243 | A * | 8/2000 | Kim | 15/390 |
| 6,131,238 | A | 10/2000 | Weber et al. | |
| 6,158,084 | A | 12/2000 | Weber et al. | |
| 6,915,544 | B2 * | 7/2005 | Roney et al. | 15/384 |
| 2005/0192142 | A1 | 9/2005 | Stone et al. | |
| 2007/0234505 | A1 * | 10/2007 | Gordon et al. | 15/354 |

OTHER PUBLICATIONS

International Search Report for corresponding International Application No. PCT/US2008/0062449 mailed on Aug. 14, 2008.

* cited by examiner

*Primary Examiner* — Dung Van Nguyen
(74) *Attorney, Agent, or Firm* — Michael Best & Friedrich LLP

(57) ABSTRACT

A vacuum cleaner includes a floor engaging portion and a handle portion pivotally mounted to the floor engaging portion. The handle portion includes an input device. An agitator is rotatably mounted in the floor engaging portion to agitate a floor surface being cleaned. A first motor has an output shaft and an agitator belt selectively drivingly connecting the motor to the agitator. A tensioning arm pivotally mounts to the floor engaging portion for motion between an agitator-on position in which the tensioning arm engages the agitator belt, to place the agitator belt under tension whereby the agitator belt drives the agitator, and an agitator-off position in which the tensioning arm does not engage the agitator belt, to place the agitator belt in a slack condition whereby the agitator belt does not drive the agitator. A lifting assembly is mounted in the floor engaging portion and includes a second motor and an engaging member driven by the second motor, the engaging member being adapted to contact the tensioning arm to selectively place the tensioning arm in the agitator-off position.

30 Claims, 15 Drawing Sheets

VACUUM CLEANER WITH ELECTRONIC AGITATOR CONTROL

BACKGROUND OF THE INVENTION

The use of agitator drive interruption mechanisms in vacuum cleaners is well known. Prior art vacuum cleaners have employed numerous configurations to selectively activate and deactivate the rotary agitator. Examples include belt shifting mechanisms, belt detensioning mechanisms, and the like.

It has been found that belt de-tensioning modules are particularly advantageous because the uncomplicated design reduces the risks of excessive belt wear and belt slipping. Such designs typically include a rotary agitator driven by a belt, and an idler arm carrying an idler pulley at one end. A spring biases the arm so that the pulley engages and thereby tensions the belt during normal, inclined operation. When the vacuum cleaner is placed in an upright position, a tab on the upper housing engages the idler arm to cause the idler pulley to pivot away from the belt. Tension is thereby released from the belt and the agitator is deactivated.

Though such arrangements have proven effective in the past, with the widespread availability and low costs associated with microprocessors, newer vacuum cleaners now include many more automated features. Consumers now expect to be able to control many or all of the vacuum cleaner functions from controls located on or proximate to the handle grip. Thus, there is a need in the art for vacuum cleaner configurations that electronically control agitator detensioning.

SUMMARY OF THE INVENTION

In general a vacuum cleaner made in accordance with the present invention includes a floor engaging portion and a handle portion pivotally mounted to the floor engaging portion for pivotal motion relative to the floor engaging portion between a generally upright storage position and an inclined pivotal operating position. An agitator is rotatably mounted in the floor engaging portion for agitating a floor surface being cleaned. A first motor has an output shaft and an agitator belt selectively drivingly connecting the motor to the agitator. A tensioning arm is pivotally mounted to the floor engaging portion for pivotal motion between an agitator-on position in which the tensioning arm engages the agitator belt, to place the agitator belt under tension whereby the agitator belt drives the agitator, and an agitator-off position in which the tensioning arm does not engage the agitator belt, to place the agitator belt in a slack condition whereby the agitator belt does not drive the agitator. A spring is mounted between the floor engaging portion and the tensioning arm for biasing the tensioning arm into the agitator-on position. A lifting assembly is mounted in the floor engaging portion and the lifting assembly includes a second motor and an engaging member driven by the second motor. The engaging member is adapted to contact the tensioning arm to selectively place the tensioning arm in the agitator-off position.

According to another aspect of the present invention, a vacuum cleaner includes a floor engaging portion, a handle portion pivotally mounted to the floor engaging portion and including at least one input device. An agitator is rotatably mounted in the floor engaging portion for agitating a floor surface being cleaned. A first motor has an output shaft and an agitator belt selectively drivingly connecting the motor to the agitator. A tensioning arm is pivotally mounted to the floor engaging portion for motion between an agitator-on position in which the tensioning arm engages the agitator belt, to place the agitator belt under tension whereby the agitator belt drives the agitator, and an agitator-off position in which the tensioning arm does not engage the agitator belt, to place the agitator belt in a slack condition whereby the agitator belt does not drive the agitator, the tensioning arm being biased toward the agitator-on position. An engaging member is selectively actuated by the input device, the engaging member being adapted to contact the tensioning arm to selectively place the tensioning arm in the agitator-off position.

According to another aspect of the present invention, a vacuum cleaner includes a floor engaging portion and a handle portion pivotally mounted to the floor engaging portion and includes at least one input device. An agitator is rotatably mounted in the floor engaging portion for agitating a floor surface being cleaned. A first motor has an output shaft and an agitator belt selectively drivingly connecting the motor to the agitator. An arm selectively engages the agitator belt and is mounted to the floor engaging portion for motion between an agitator-on position in which the agitator belt drives the agitator, and an agitator-off position in which the agitator belt does not drive the agitator. An engaging member is responsive to the input device to selectively place the tensioning arm in the agitator-off position.

A preferred exemplary vacuum incorporating the concepts of the present invention is shown by way of example in the accompanying drawings without attempting to show all the various forms and modifications in which the invention might be embodied, the invention being measured by the appended claims and not by the details of the specification.

BRIEF DESCRIPTION OF THE DRAWINGS

A preferred embodiment of the present invention will now be described, by way of example, with reference to the accompanying drawings, of which.

DETAILED DESCRIPTION OF THE INVENTION

Figure 1:
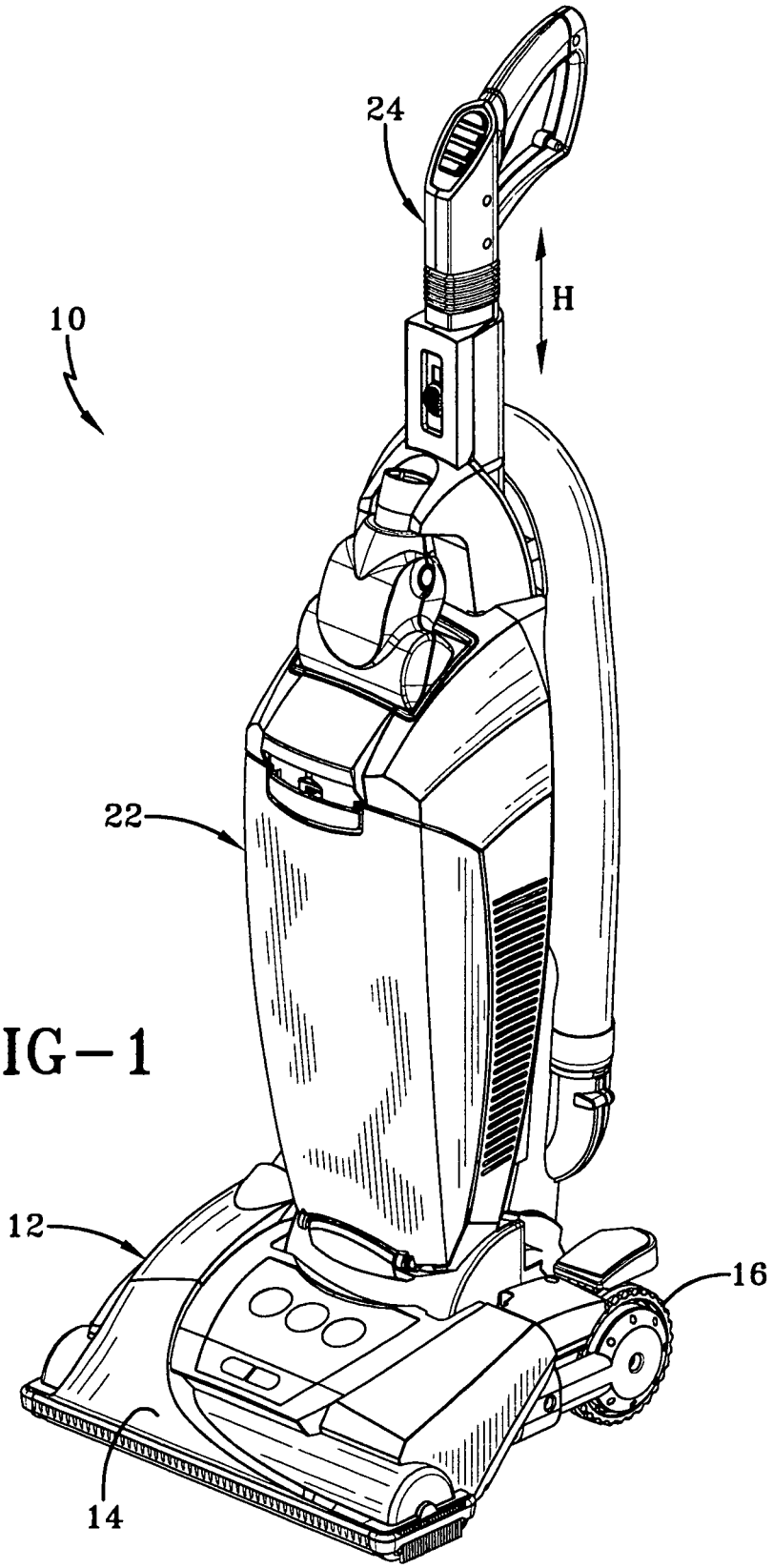
FIG. 1 is a perspective view of an upright vacuum cleaner according to the present invention.

A self-propelled upright vacuum cleaner 10 according to a preferred embodiment of the present invention is shown in FIG. 1. The cleaner includes a foot or lower portion 12. The lower portion includes a floor nozzle 14, that is fluidly connected to a dirt receptacle and a vacuum source (not shown). Freely rotating support wheels 16 (only one of which is visible in FIG. 1) are located to the rear and on opposite sides of the lower portion. The lower portion may further include a transmission 18 (See FIG. 2) and drive wheels 20 for propelling the cleaner over a floor. It should be appreciated that, though the presently disclosed embodiment is self-propelled, the belt tensioning device of the present invention may be employed in non-propelled vacuums.

The details of the transmission 18 do not form a part of the present invention and are therefore not disclosed in detail herein. However, a suitable transmission for use with a self-propelled upright vacuum cleaner according to the present invention is disclosed in U.S. Pat. No. 3,581,591, the disclosure of which is hereby incorporated herein as of reference.

An upper housing or handle portion 22 is pivotally mounted to the lower portion 12 in a conventional manner for pivotal motion from a generally upright storage position, to an inclined pivotal operating position. A hand grip 24 may be slidably mounted to the top end of upper housing 22 for limited reciprocal motion relative thereto, as illustrated by arrow H in FIG. 1. Hand grip 24 may be connected to the transmission 18, via a Boudin type control cable (not shown) or the like. A suitable actuating mechanism and transmission for use with upright vacuum cleaners according to the present invention is disclosed in U.S. Pat. No. 6,158,084, which is hereby incorporated by reference. As an operator pushes and pulls on hand grip 24, the cable actuates transmission 18 to automatically drive cleaner 10 forward and reverse in response to the forces applied to hand grip 24 by the operator. The details of the reciprocating hand grip 24 do not form a part of the present invention and are therefore not described in detail herein. Suitable hand grips for use with a self-propelled upright vacuum cleaner according to the present invention are disclosed in U.S. Pat. Nos. 3,618,687 and 5,339,916, the disclosures of which are hereby incorporated herein as of reference.

A nozzle body, generally indicated as 30, defines a transversely extending agitator chamber 32 having a downward opening nozzle or suction opening 34. A rotary agitator 36 is rotatably mounted in agitator chamber 32 in a conventional manner with its bristles extending out nozzle opening 34 for agitating a carpet.

Figure 4:
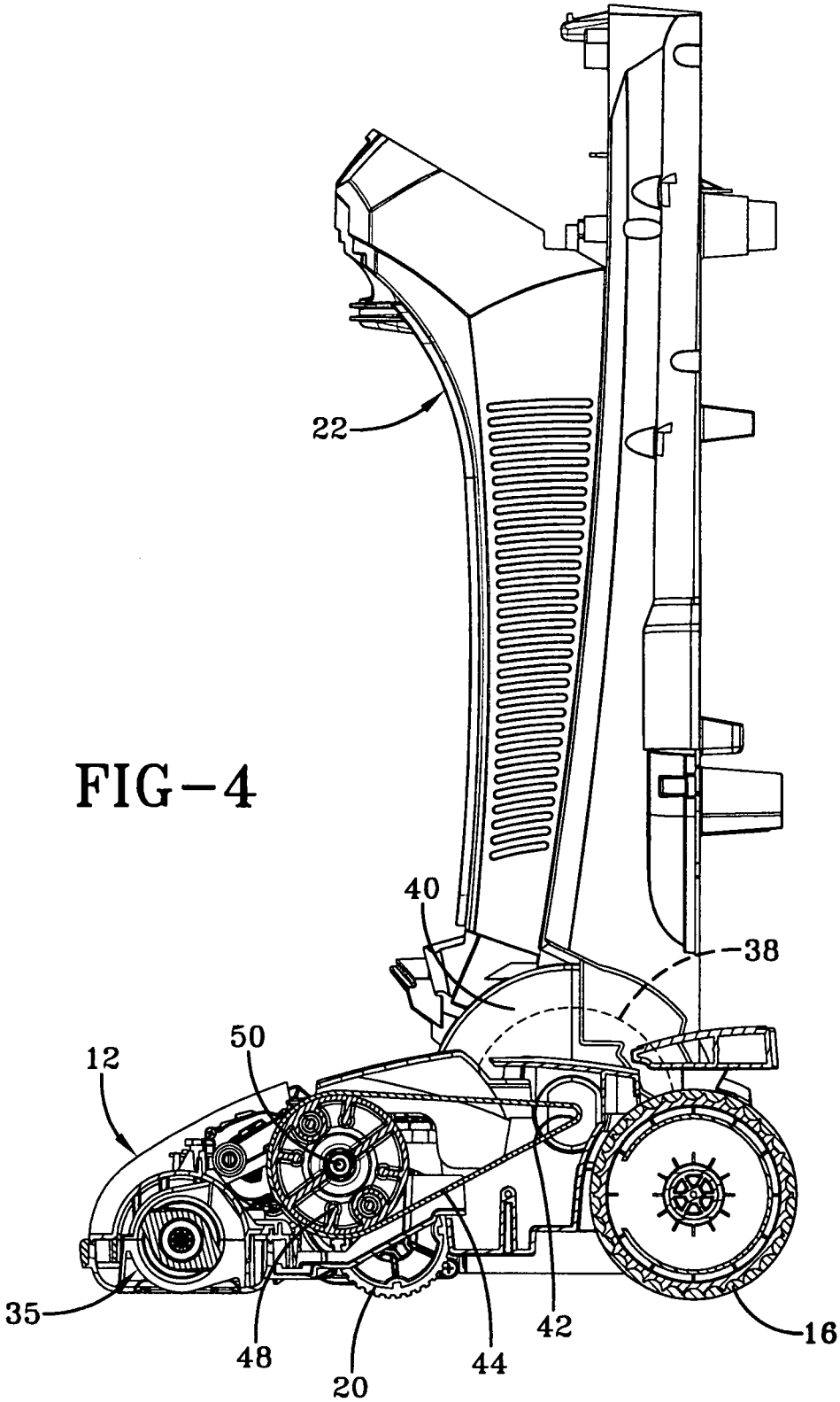
FIG. 4 is a cross-sectional view taken along line 4-4 in FIG. 3.

Referring now to FIG. 4, an electric motor 38 (shown in ghost in FIG. 4) for powering cleaner 10 is located in a motor housing 40 defined by the lower end of the handle portion 22. Motor 38 is preferably arranged such that a rotor shaft 42 extends horizontally and out both ends of motor housing 40. A conventional fan (not shown) may be affixed to one end of rotor shaft (not shown) for generating suction. The other end of the rotor shaft 42 is utilized to drive transmission 18 and agitator 36 via a drive belt 44 and an agitator belt 46. The drive belt 44 extends from rotor shaft 42 to a first pulley 48 fixed to a transmission input shaft 50. The agitator belt 46 extends from a second pulley 52, fixed to transmission input shaft 50, to a third pulley 54 integrally formed on agitator 36. Second pulley 52 has a diameter that is smaller than the diameter of first pulley 48 in order to provide a speed reduction between rotor shaft 42 and agitator 36.

Upper housing 22 may be mounted to foot 12 such that the distance between motor shaft 42 and transmission input shaft 50 remains constant as the upper housing pivots relative to foot 12. Drive belt 44 may be a conventional stretch belt having a flat or rectangular cross-section. Drive belt 44 may be stretched between motor shaft 42 and first pulley 48, such that it's natural elasticity maintains drive belt 44 under tension for transmitting power from motor 38 to transmission 18.

Agitator belt 46 has a length that is greater than the distance between second pulley 52 and agitator 36, such that there is slack in agitator belt 46. In order to engage agitator 36, an idler pulley 56 is mounted on one end of an idler arm 58 which is pivotally mounted adjacent to agitator belt 46. To that end, idler arm 58 includes a shaft portion 59 that is received in a cradle 60 integrally molded into the nozzle body 30. A spiral torsion spring 62 may be mounted under tension proximate to the top of cradle 60 and biases idler arm 58 in a first direction about its pivot axis to press idler pulley 56 against agitator belt 46 (shown in FIG. 5). In this manner, idler pulley 56 maintains agitator belt 46 under relatively constant tension and places it under tension thereby enabling the transfer of power from second pulley 52 to the agitator 36.

Figure 2:
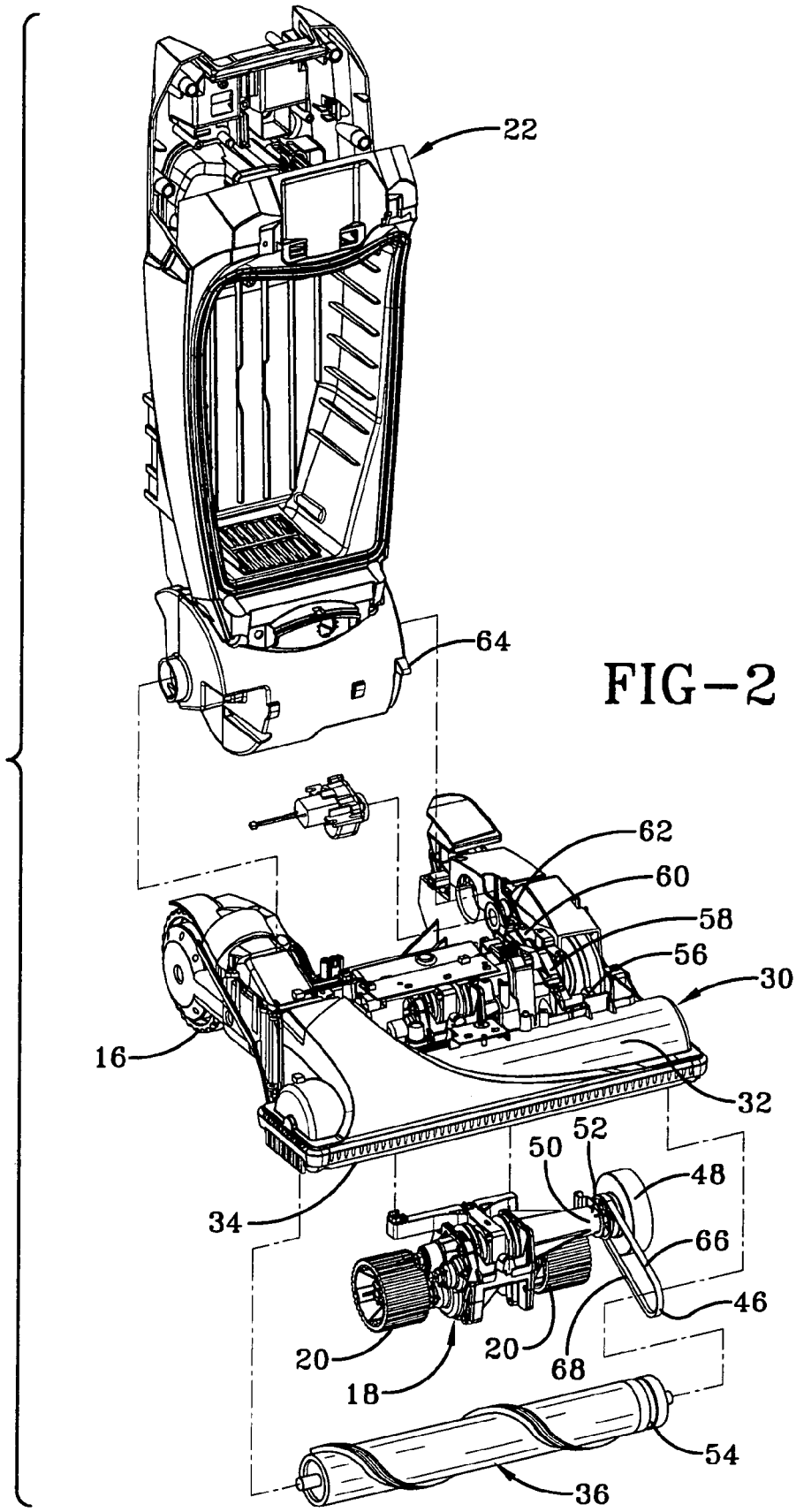
FIG. 2 is a partially exploded view of an upright vacuum cleaner according to the present invention with the lower portion cover removed.
Figure 3:
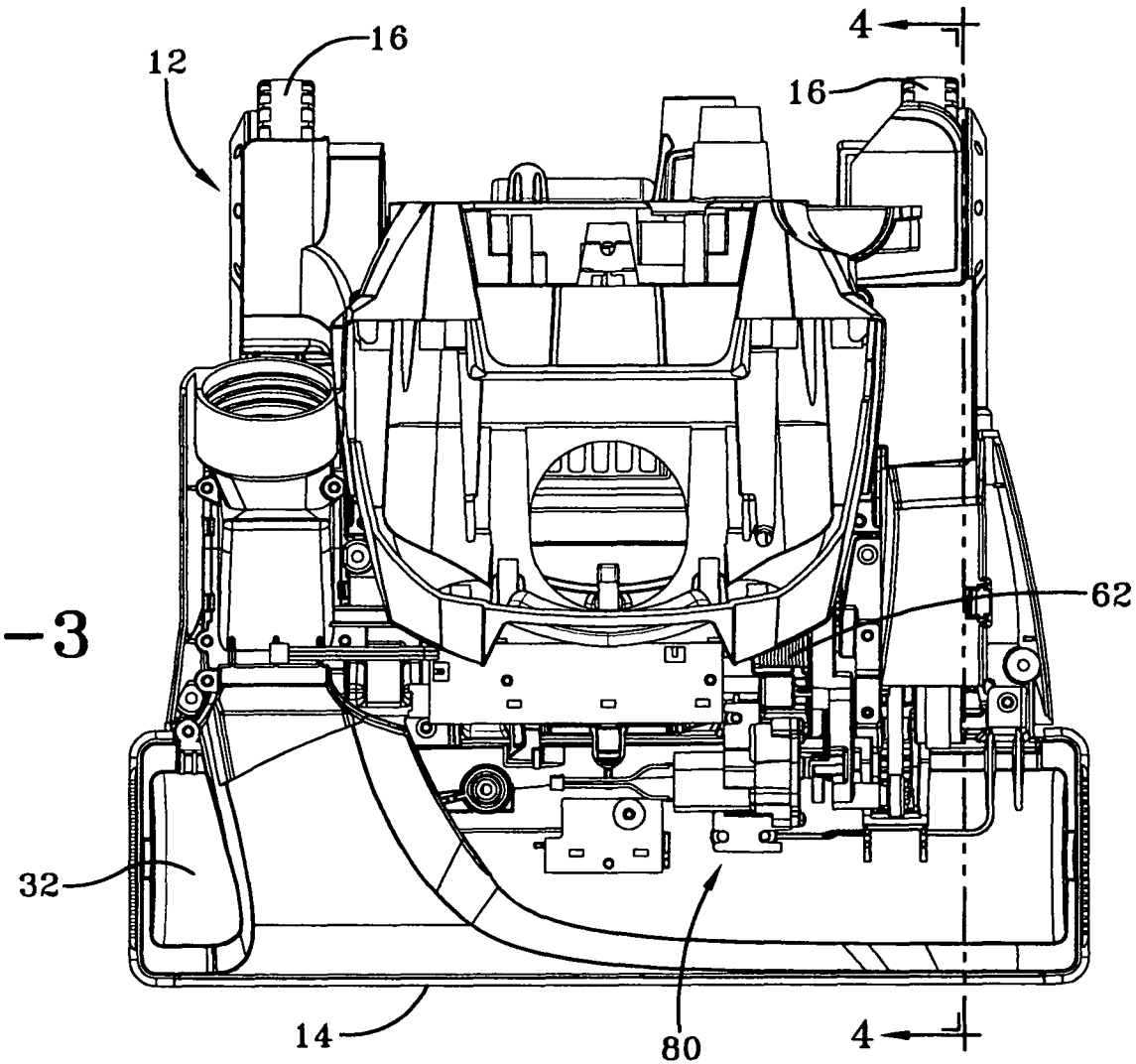
FIG. 3 is a top plan view of the lower portion of a vacuum cleaner according to the present invention with the top cover removed.
Figure 5:
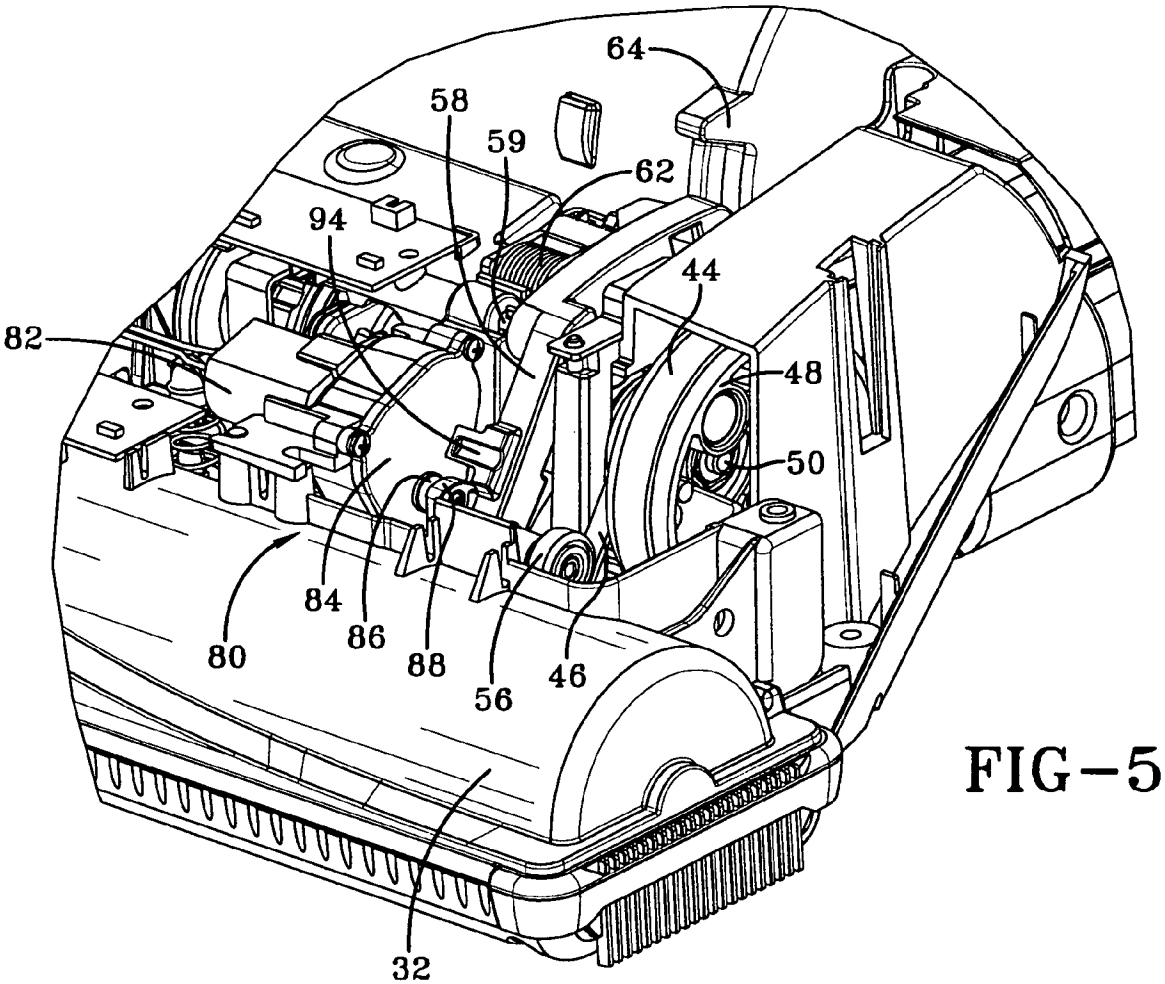
FIG. 5 is a partial perspective view of the lower portion of the upright vacuum cleaner with the cover removed, and illustrates the cleaner with the handle portion in the inclined operating position and the engaging element in the agitator-on position.
Figure 6:
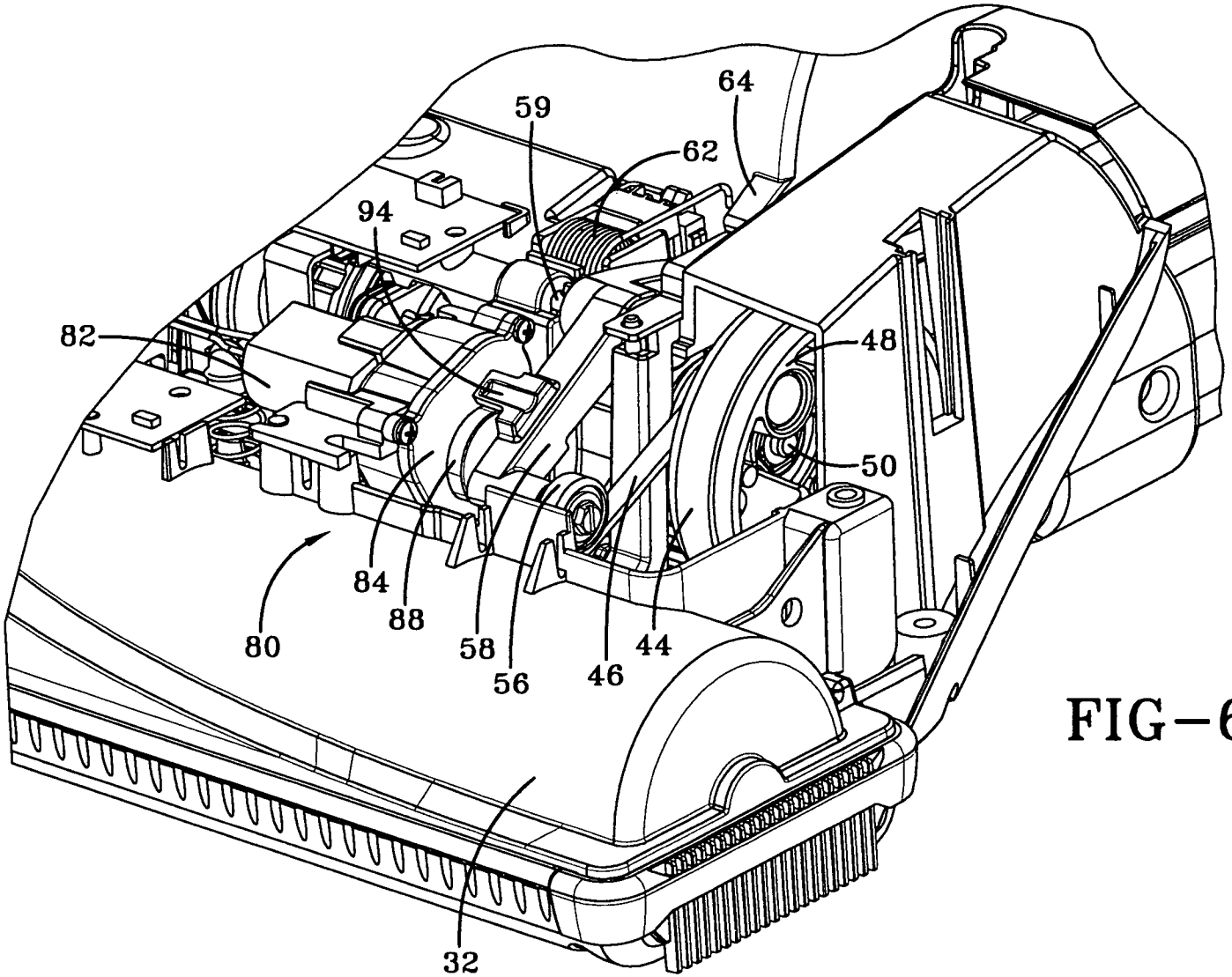
FIG. 6 is a partial perspective view of the lower portion of the upright vacuum cleaner with the cover removed and illustrates the cleaner with the handle portion in the upright operating position and the engaging element in the agitator-off position.

As illustrated in FIGS. 2, 5 and 6, a protrusion 64 is integrally molded into motor housing 40. Protrusion 64 is located on the motor housing so that as handle portion 22 is raised to the storage or upright position, protrusion 64 contacts idler arm 58 at a location spaced from the cradle 60 and on the opposed side from idler pulley 56. When protrusion 64 contacts idler arm 58, it pivots idler arm 58 in a second direction about its pivot axis, opposite the first direction, to move idler pulley 56 out of engagement with the agitator belt 46 (shown in FIG. 6). Agitator belt 46 is thus placed in a slack condition to disengage agitator 36 from second pulley 52 and from motor 38. A similar vacuum cleaner agitator belt drive release is disclosed in commonly owned U.S. Pat. No. 5,537,712, the disclosure of which is hereby incorporated herein as of reference.

Using an idler pulley to place a slack agitator belt under tension enables the use of a V-belt, formed of rubber reinforced with a relatively stiff, inelastic and durable cord material to transmit power from second pulley 52 to agitator 36. Agitator belt 46 may have an initial circular or round configuration. Such a V-belt is durable enough to last for virtually the lifetime of the vacuum cleaner under normal operating conditions, thereby significantly reducing the need to replace agitator belt 46 under normal usage of the vacuum cleaner. Drive belt 44, on the other hand, may advantageously be a stretch belt having a flat or rectangular shape in cross-section that is formed of a relatively elastic rubber material. The length of drive belt 44 may be less than the distance between motor shaft 42 and first pulley 48, whereby the drive belt must be stretched to be mounted therebetween. Thus, the drive belt is mounted under tension, such that the natural elasticity of drive belt 44 maintains it under tension.

Drive belt 44 may be less expensive and less durable than agitator belt 46 according to the present invention. Accordingly, drive belt 44 is designed to slip on motor output shaft 42 when agitator 36 is accidentally stalled. Thus, drive belt 44 acts as an overload clutch that allows motor 38 to continue to rotate when agitator 36 stalls, thereby preventing motor 38 from damage. As a result, drive belt 44 may require replacement during the lifetime of the vacuum cleaner. As discussed above, agitator belt 46 is designed to last considerably longer than drive belt 44. Therefore, second pulley 52 is located on transmission input shaft 50 inside of first pulley 48, so that agitator belt 46 does not have to be removed in order to replace drive belt 44.

When idler pulley 56 is moved away from the agitator belt 46, the natural stiffness and resiliency causes the upper 66 and lower 68 expanses of agitator belt 46 to bow radially outwardly toward its initial circular shape until the agitator belt contacts belt guides (not shown) that constrains further movement. Since further outward bowing of the upper 66 and lower 68 expanses of agitator belt 46 is prevented, upper 66 and lower 68 expanses are maintained in a substantially straight planar configuration. As upper expanse 66 straightens, the ends of the agitator belt 46 (i.e. where agitator belt 46 wraps around second and third pulleys 52 and 54) move away from each other. The end of agitator belt 46 that is wrapped around third pulley 54 is prevented from moving away from third pulley 54 by the close proximity of an inner peripheral surface (not shown) of the nozzle body 30. Consequently, the end of agitator belt 46 that is wrapped around second pulley 52 moves away from the second pulley 52. In this manner, agitator belt 46 is lifted clear of second pulley 52. It is of course advantageous that agitator belt 46 be lifted from second pulley 52 rather than third pulley 54, because second pulley 52 is continuously driven by motor 38. If agitator belt 46 were to remain in contact with second pulley 52 when not under tension, it would slip on second pulley 52 and the resulting friction would damage both agitator belt 46 and second pulley 52.

It can thus be seen that agitator 36 is automatically disengaged when vacuum cleaner 10 is placed in the upright position and engaged when vacuum cleaner 10 is placed in an inclined position. Disengaging agitator 36 when vacuum cleaner 10 is upright prevent damage to carpeting if a user inadvertently leaves vacuum cleaner 10 on while in the upright position.

Figure 7:
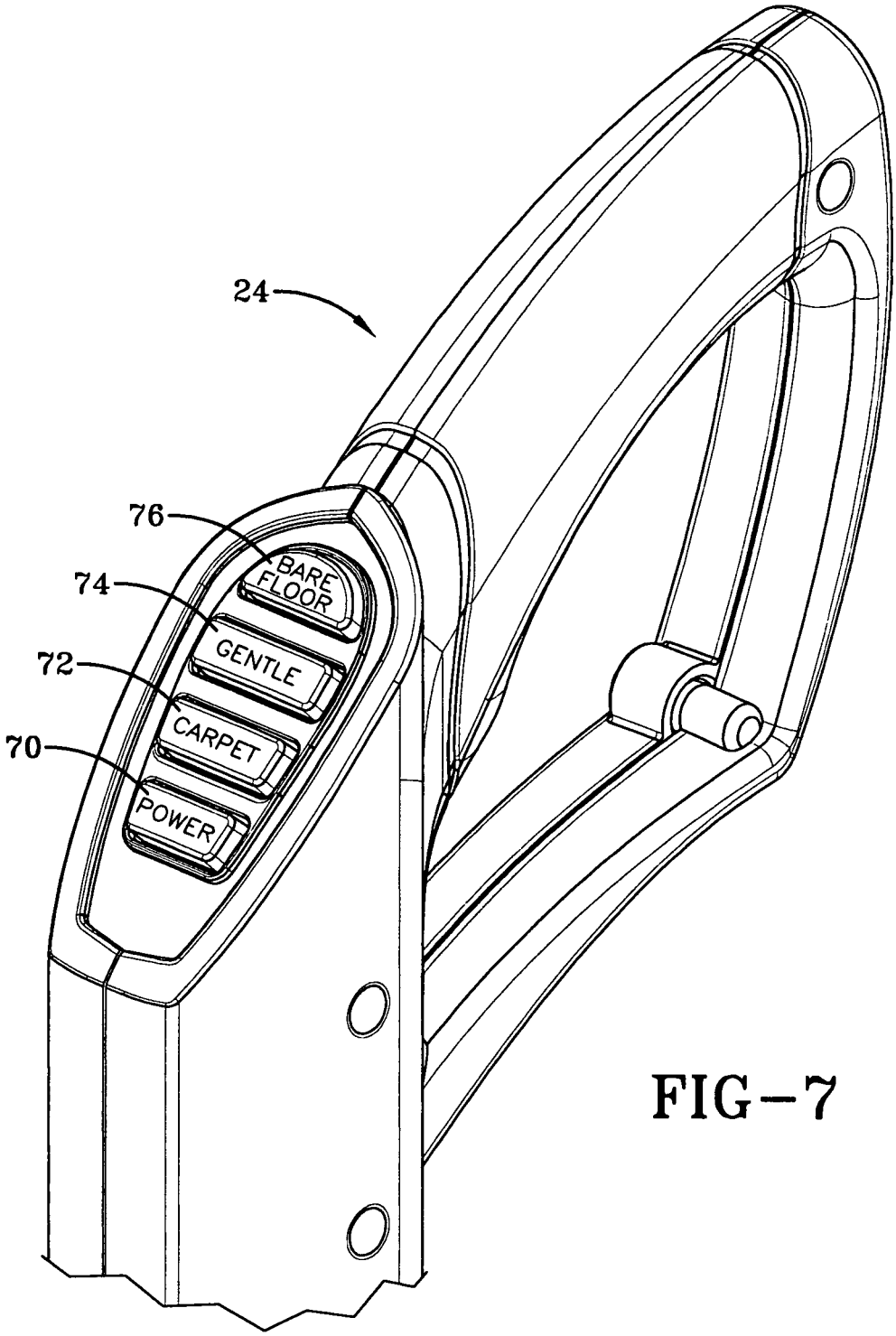
FIG. 7 is an enlarged perspective view of the handle grip.

Vacuum cleaner 10 of the present invention may include a plurality of user selected operating modes. Conveniently, one or more user assessable input devices may be provided on upper housing 22 that actuate the various cleaner modes. In one embodiment, a plurality of mode selection buttons may be provided on hand grip 24. As shown in FIG. 7, vacuum cleaner 10 includes three modes of operation. Consequently, hand grip 24 includes a power button 70 that is depressed to selectively energize and de-energize vacuum cleaner 10. A "Carpet" button 72, upon depression, places vacuum cleaner 10 in a carpet cleaning mode. Carpet cleaning mode corresponds to full power actuation of vacuum motor 38 and powered rotation agitator 36. Depression of a "Gentle" button 74 places vacuum cleaner 10 in a gentle cleaning mode that corresponds to a reduced power supply to vacuum motor 38 and powered rotation of agitator 36. It should be appreciated that, because agitator 36 is powered by vacuum motor 38, reduced vacuum motor speed results in reduced rotating speed of agitator 36. Finally, depression of a "Bare Floor" button 76 places vacuum cleaner 10 in a bare floor mode that corresponds to full power actuation of vacuum motor 38, wherein agitator 36 is disengaged.

In one embodiment, buttons 72, 74 and 76 transmit a unique voltage signal to a microcontroller (not shown) which in turn controls vacuum motor power and agitator engagement. It should, however, be appreciated that other circuitry configurations may be employed that electronically control vacuum cleaner modes based on user inputs.

As discussed above, bare floor mode requires agitator 36 to be disengaged. This is accomplished by an idler lifting assembly 80 that is responsive to control signals from the microcontroller. Referring now to FIGS. 5 and 6, lifting assembly 80 includes an electric cam motor 82 mounted within foot 12. When provided with power, cam motor 82 rotates an output shaft (not shown) that is received in a gear box 84. Gear box 84 includes one or more internal gears that interrelate the cam motor output shaft to a gear box output shaft 86. Thus, rotation of cam motor shaft causes output shaft 86 to rotate. Output shaft 86 carries a cam 88 in the shape of an asymmetrical lobe having a curved surface 90 and a straight edge 92. As will be hereinafter discussed, cam 86 may be positioned in two operating positions. In a first, belt tensioned, or agitator-on position (shown in FIGS. 5, 8 and 9), straight edge 92 extends downwardly from output shaft 86. In a second, de-tensioned, or agitator-off position (shown in FIGS. 6, 10 and 11), cam 88 is rotated about 180 degrees from the first position and straight edge 92 now extends upwardly from output shaft 86. As will be hereinafter discussed, cam 88 selectively engages a tab 94 that extends from idler arm 58 toward gear box 84.

Figure 8:
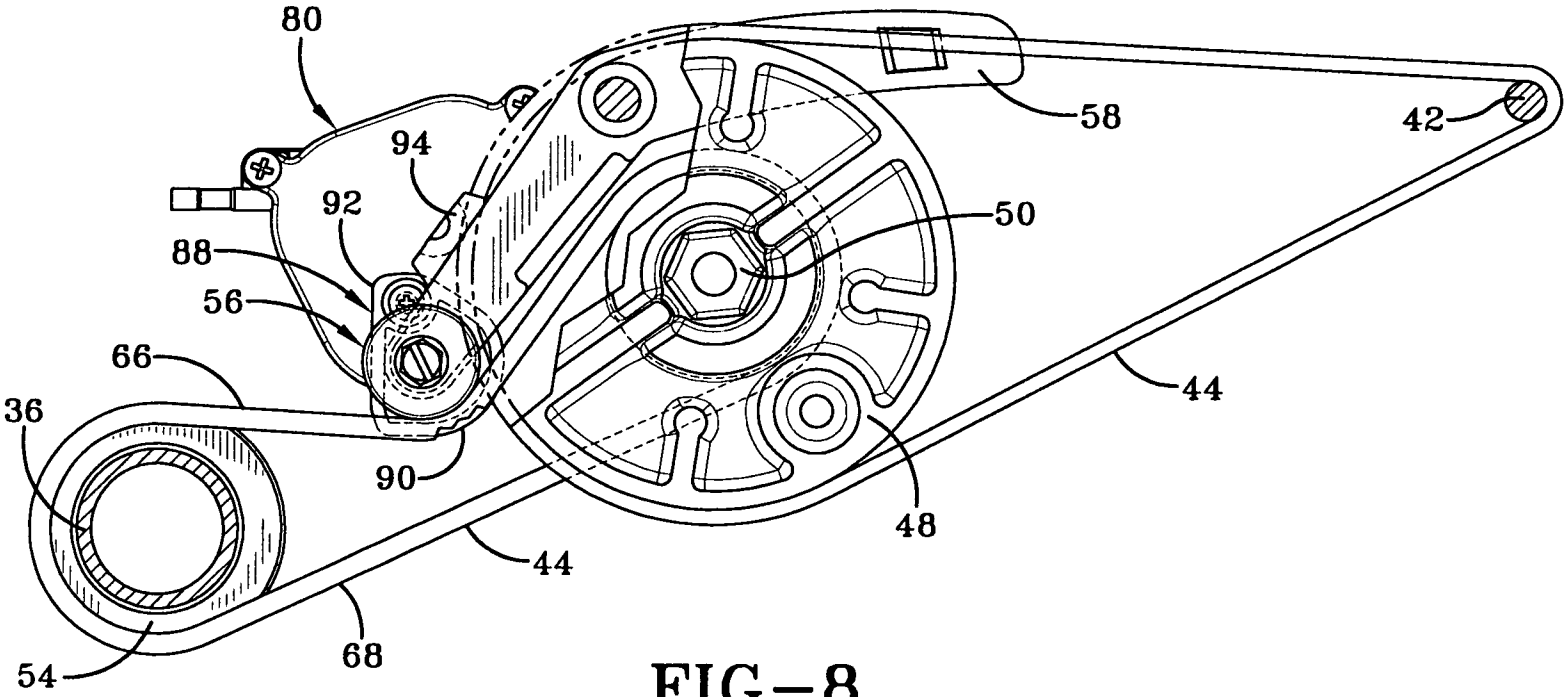
FIG. 8 is a side view of the idler arm and lifting assembly according to the present invention, illustrating the engaging element in the agitator-on position.
Figure 9:
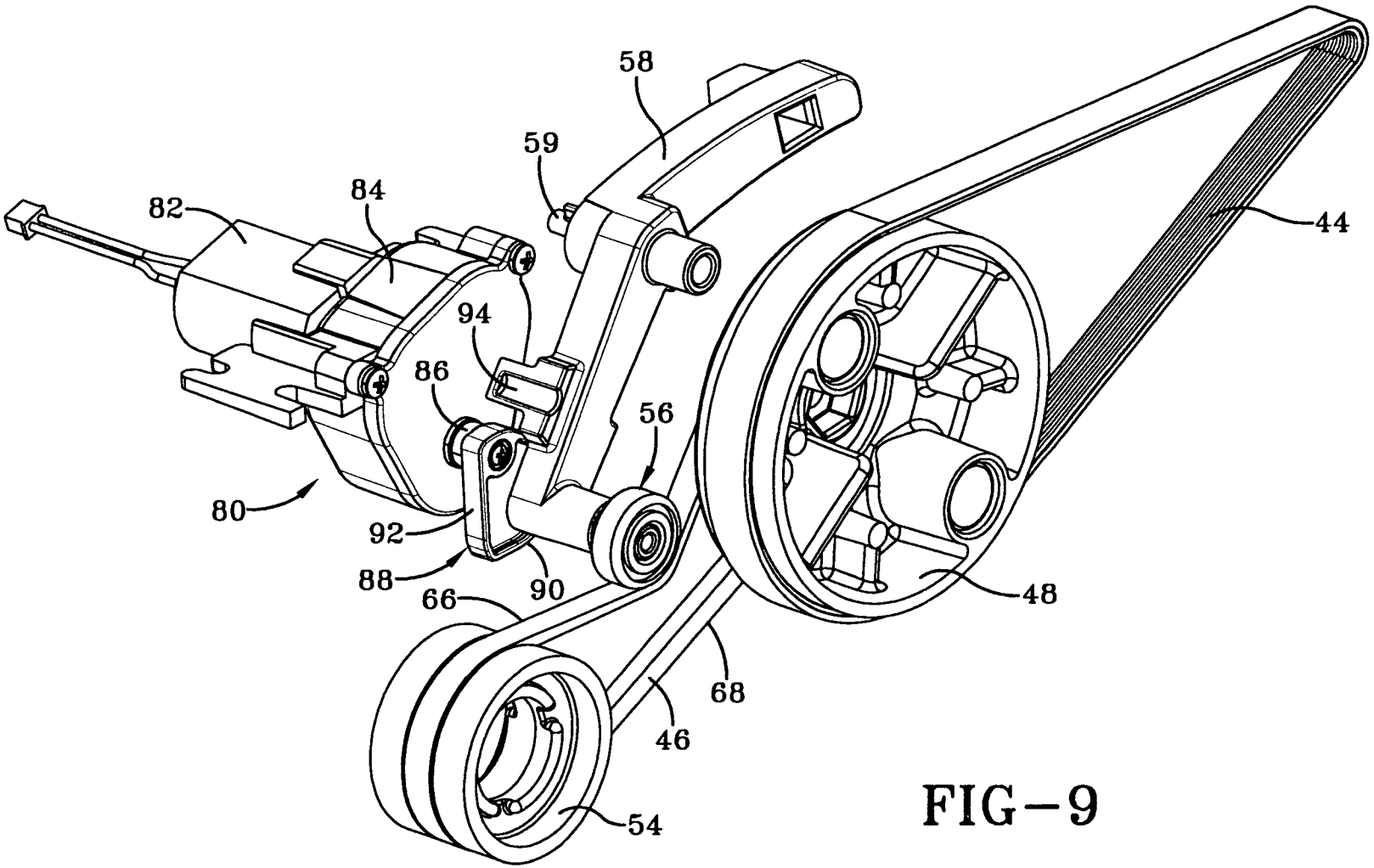
FIG. 9 is a perspective view of the idler arm and lifting assembly illustrating the engaging element in the agitator-on position.

Referring now to FIGS. 8 and 9, it can be seen that cam 88 is in the first, belt tensioned position wherein straight edge 92 extends downwardly. While in this orientation, cam 88 does not interfere with or other wise contact idler arm 58, which will press idler pulley 56 against belt 46 under the bias force of spring 62. Cam 88 is positioned in the first, belt tensioned position, when vacuum cleaner 10 is in either gentle mode or carpet mode. When vacuum cleaner 10 is placed in bare floor mode, the microcontroller causes cam motor 82 to rotate, which in turn causes cam 88 to rotate.

Figure 10:
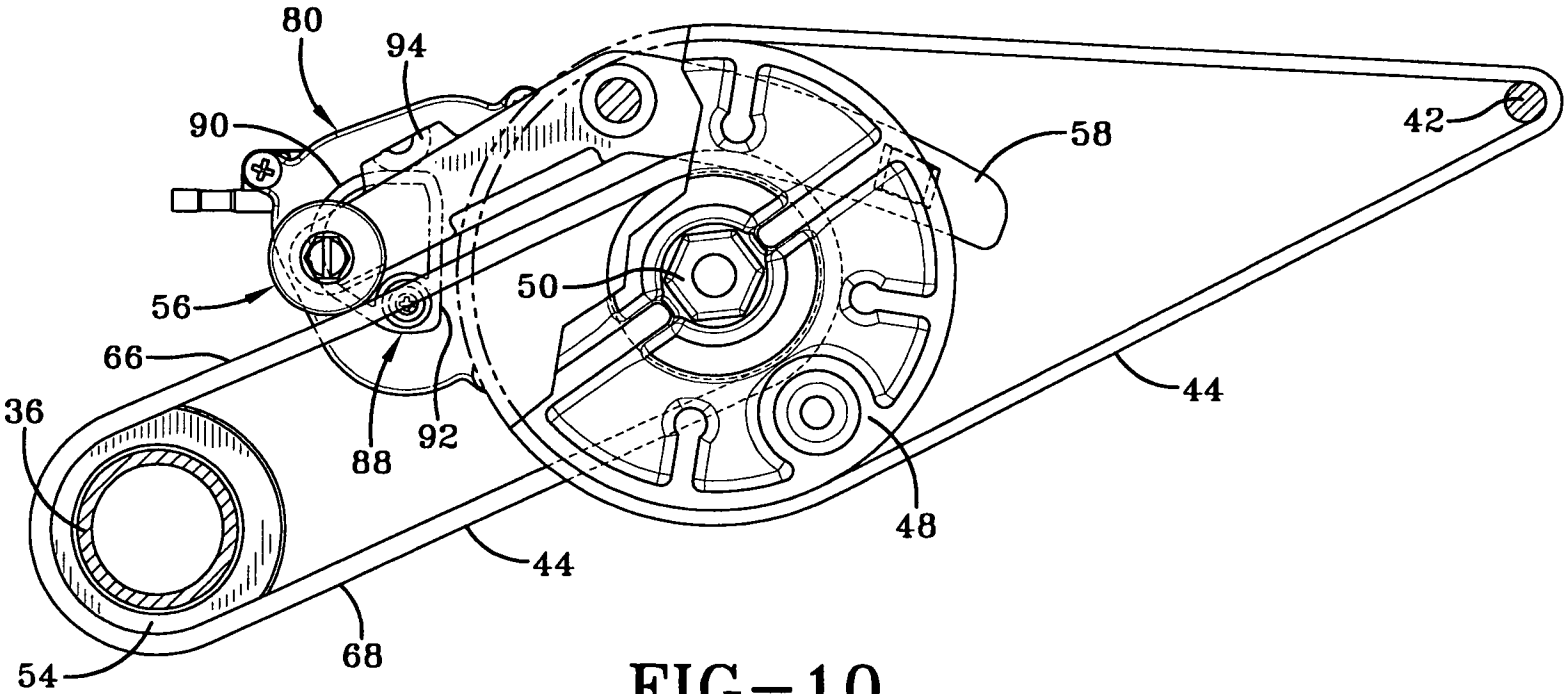
FIG. 10 is a side view of the idler arm and lifting assembly, illustrating the engaging element in the agitator-off position.
Figure 11:
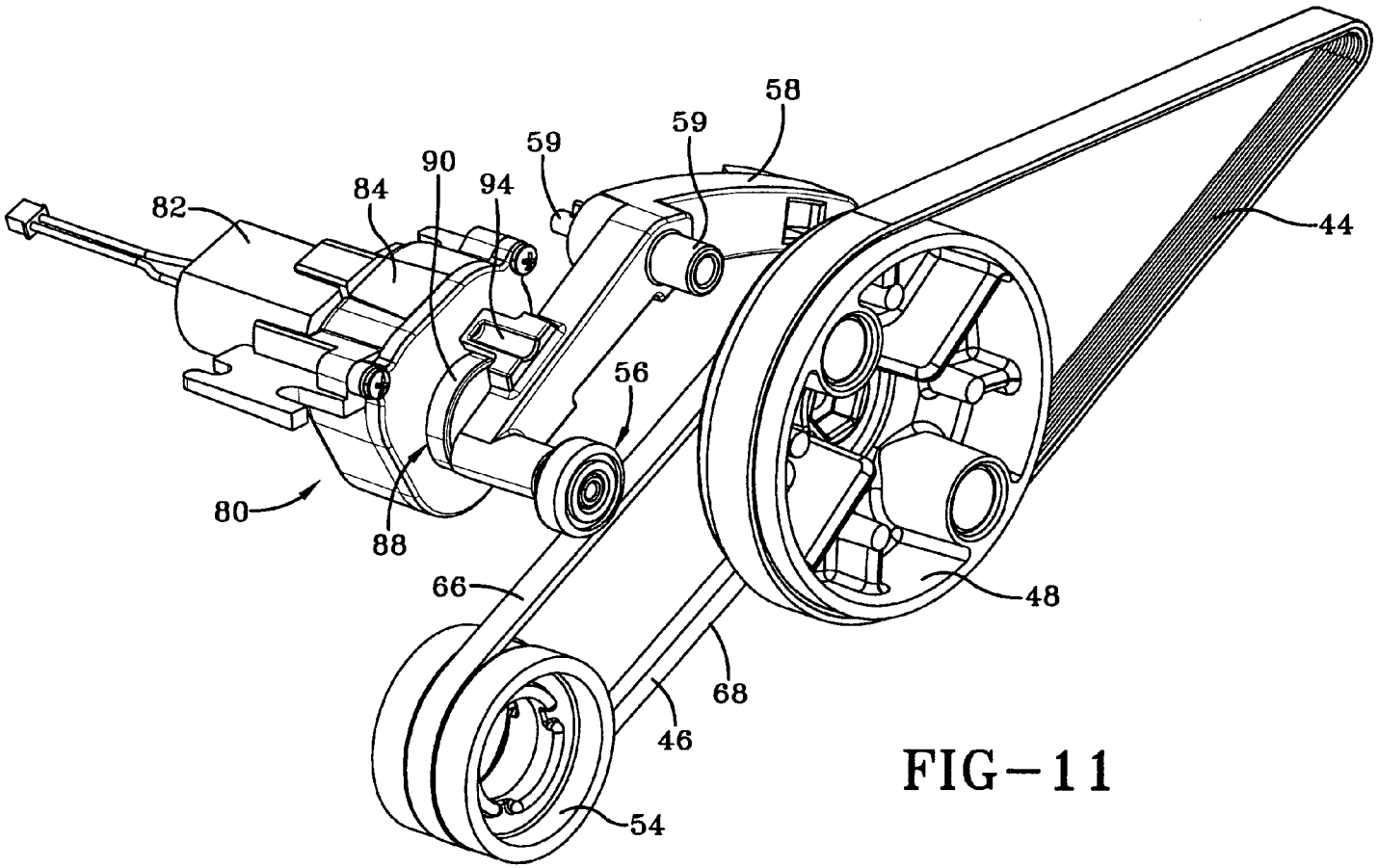
FIG. 11 is a perspective view of the idler arm and lifting assembly illustrating the engaging element in the agitator-off position.
Figure 12:
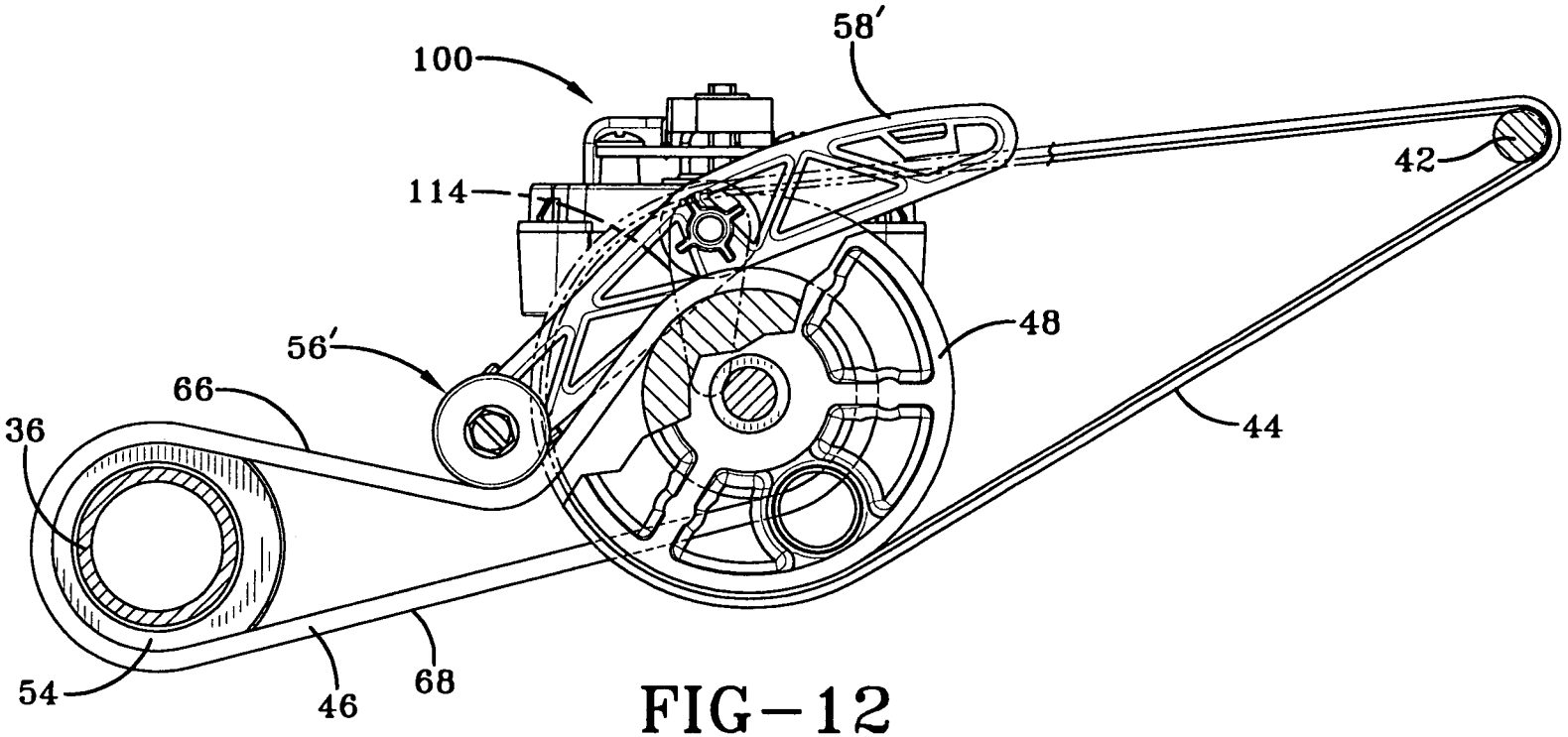
FIG. 12 is a side view of an alternate embodiment of the idler arm and lifting assembly illustrating the engaging element in an agitator-on position.
Figure 13:
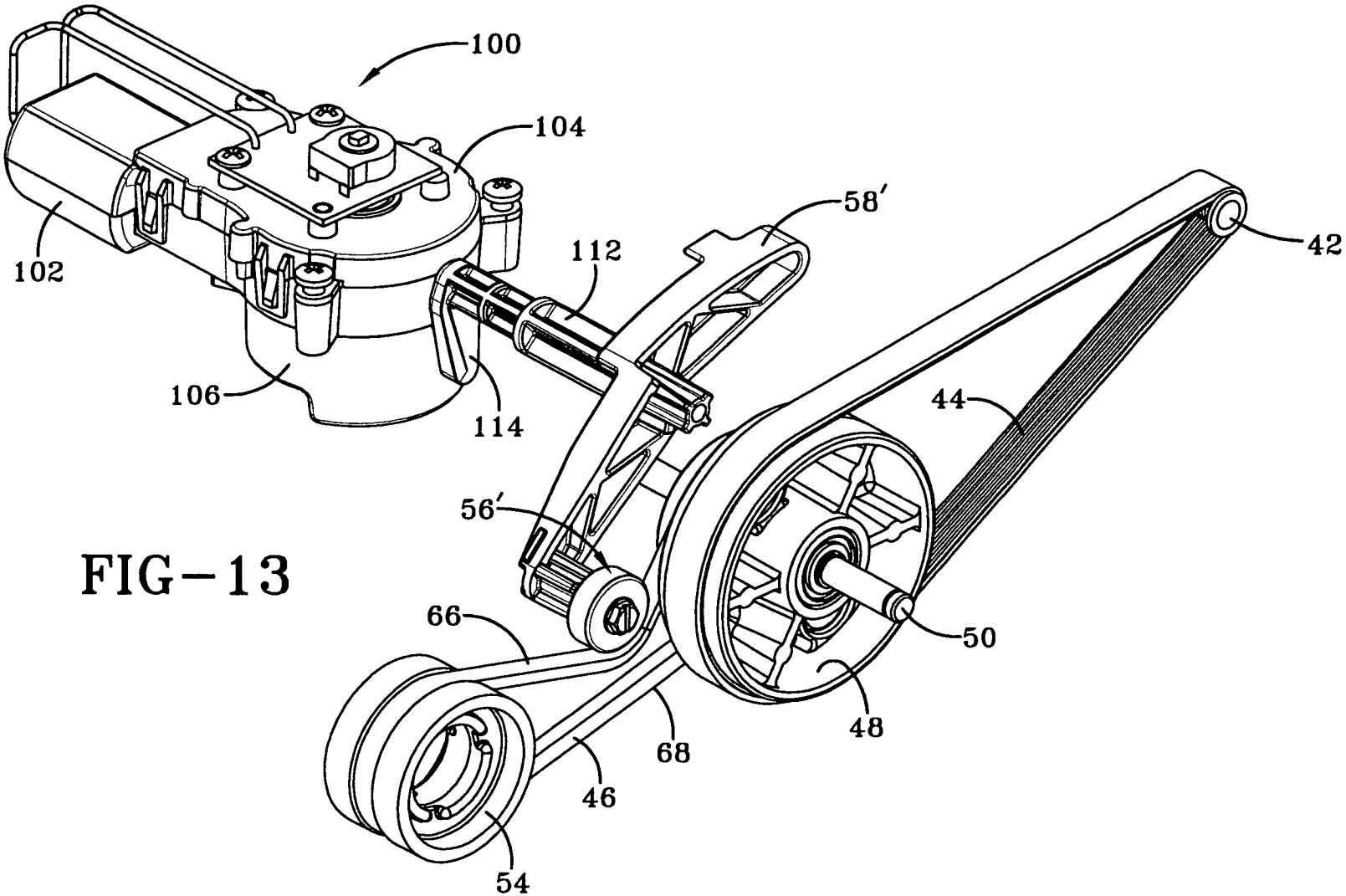
FIG. 13 is a perspective view of the alternate embodiment of the idler arm and lifting assembly illustrating the engaging element in the agitator-on position.

Referring now to FIGS. 10 and 11, cam 88 rotates counterclockwise so that curved surface 90 contacts tab 94. Thereafter, tab 94 will slide along curved surface 90 until cam 88 reaches the second, de-tensioning position. As discussed above, when in this orientation, straight edge 92 extends upwardly and idler arm 58 is correspondingly raised so that idler pulley 56 is drawn away from agitator belt 46. It should be appreciated that idler pulley 56 may or may not be completely removed from belt 46, but is sufficiently raised to cause slack in belt 46. If vacuum cleaner 10 is thereafter placed in gentle or carpet mode, the operation is reversed, and cam 88 rotates clockwise back to the first, belt tensioned position.

In one or more embodiments, cam 88 is limited to rotational travel of only about 180 degrees. The rotational limits may be controlled in any number of ways. In one embodiment, the gear box may include internal gear stops that prevent gear movement past preset rotational positions. In such an embodiment, the microcontroller could monitor the current draw of the cam motor, sense a current increase when the gear stop is hit, and shut off cam motor in response. In other embodiments, stepper motors or the like may be used, that are capable of precise rotational control. Such an embodiment may not require a gear box, and consequently may directly drive cam 88. In still other embodiments, a sensor may be positioned and adapted to directly sense the first and second positions of cam 88 and control the cam motor accordingly.

Referring now to FIGS. 12-15, an alternate idler lifting assembly 100 is shown. As before, an electric cam motor 102 is mounted within foot 12 which, when provided with power, rotates an output shaft (not shown) that is received in a gear box 104. Gear box 104 includes one or more internal gears that mechanically interrelate cam motor 102 to a rotating collar 106. In contrast to cam 88, which rotates about an axis generally parallel to the surface being cleaned, collar 106 rotates about an axis generally perpendicular to the surface being cleaned. Collar 106 includes a radially extending lip 108 (See FIG. 15) having a sloped leading edge 110. Idler arm 58' is generally similar to the idler arm 58 described above, but includes an extended central pivot shaft 112, a portion of which rests in cradle 60. Thus, idler arm 58' rotates about the axis defined by shaft 112. A rounded finger 114 extends downwardly from the end of shaft 112 and is adapted to selectively engage lip 108 as will be hereinafter described.

As with cam 88, collar 106 may be positioned in two operating positions. In a first, belt tensioned or agitator-on position (shown in FIGS. 12 and 13), finger 114 extends downwardly from shaft 112 and lip 108 is rotated out of engagement with finger 114. While in this orientation, lip 108 does not interfere with idler arm 58', which will press idler pulley 56' against belt 46 under the bias force of spring 62. Collar 106 is placed in first, belt tensioned position, when vacuum cleaner 10 is in either gentle mode or carpet mode. When vacuum cleaner 10 is placed in bare floor mode, the microcontroller causes cam motor 102 to rotate, which in turn causes collar 106 to rotate.

Figure 14:
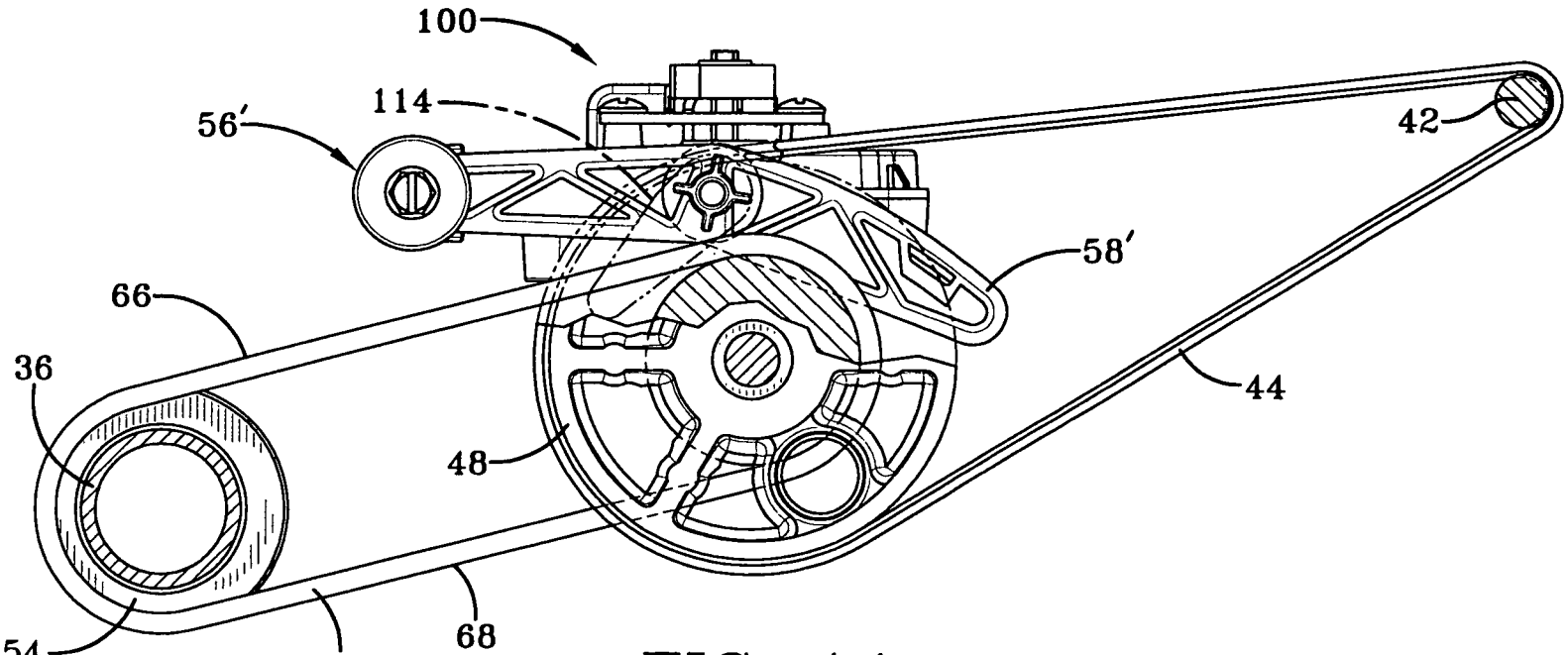
FIG. 14 is a side view of the alternate embodiment of the idler arm and lifting assembly illustrating the engaging element in an agitator-off position.
Figure 15:
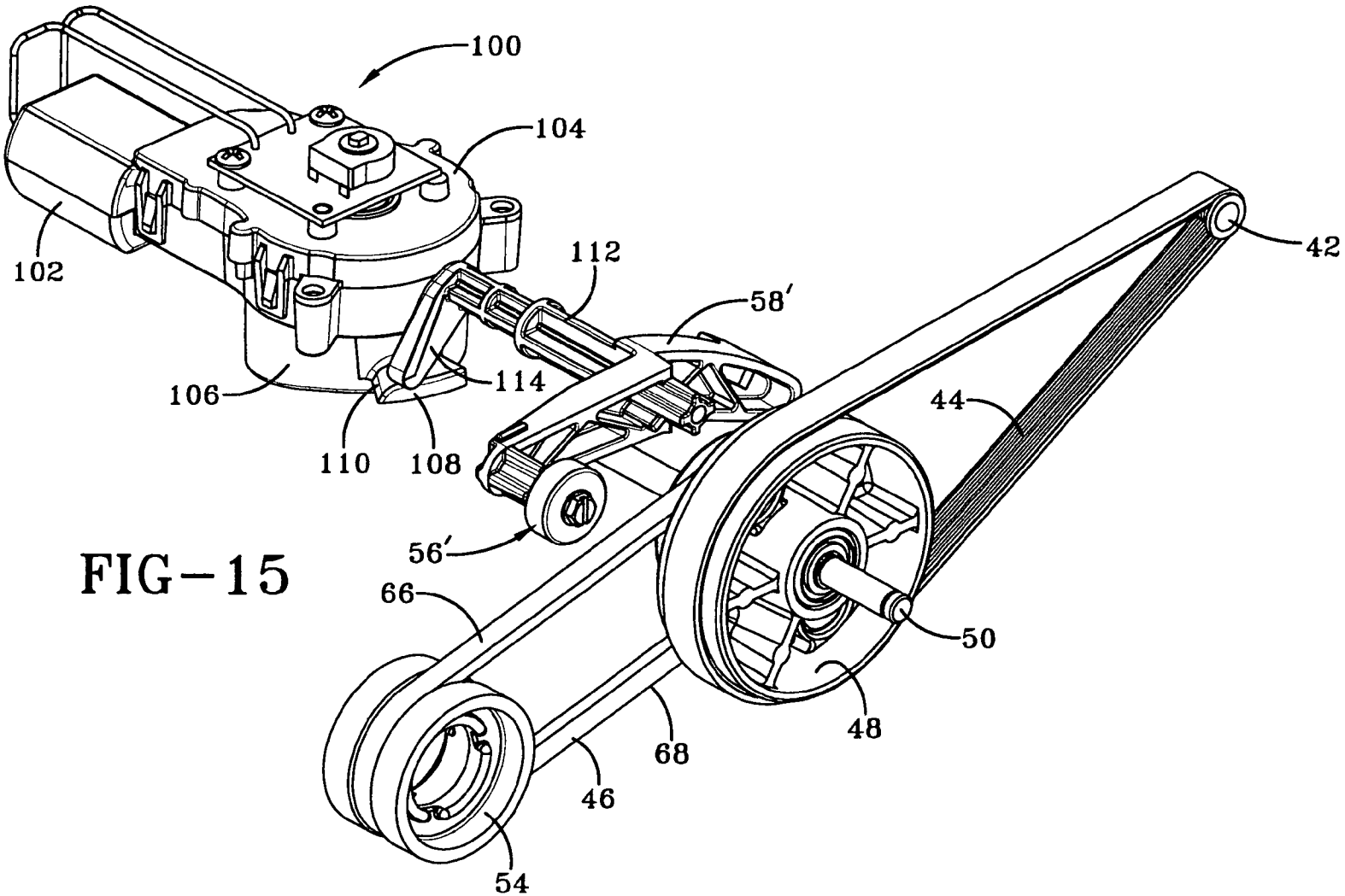
FIG. 15 is a perspective view of the alternate embodiment of the idler arm and lifting assembly illustrating the engaging element in the agitator-off position.

Referring now to FIGS. 14 and 15, collar 106 rotates so that leading edge 110 of lip 108 contacts finger 114. Thereafter, finger 114 will slide along lip 108 until collar 106 reaches the second, de-tensioning or agitator-off position. As shown in FIG. 15, lip 108 causes finger 114 to rotate about the idler arm pivot axis, which consequently rotates idler arm 58' clockwise. Clockwise rotation of idler arm 58' raises idler pulley 56' away from agitator belt 46. It should be appreciated that idler pulley 56' may or may not be completely removed from belt 46, but is sufficiently raised to cause slack in belt 46. If vacuum 10 is thereafter placed in gentle or carpet mode, the operation is reversed, and collar 106 rotates back to the first, belt tensioned position.

It will be appreciated that each of the above described lifting assemblies 80 and 100 work in a complementary fashion with the protrusion 64 on upper housing 22. In other words, inclusion of lifting assemblies 80 and 100 will not prevent the automatic deactivation of agitator 36 when vacuum 10 is placed in the upright orientation. However, it should be appreciated that lifting assemblies according to the present invention may advantageously replace functionality of protrusion 64. Such an embodiment may include a sensor that senses the vacuum cleaner is in the upright position, relaying such information to the microcontroller, which in turn commands lifting assembly to place idler arm 58 in the agitator-off position.

The present invention has been described above using a preferred embodiment by way of example only. The true scope and breadth of the invention is set forth in the following claims.

The invention claimed is:

1. A vacuum cleaner comprising:

a floor engaging portion;

a handle portion pivotally mounted to said floor engaging portion and configured for pivotal motion relative to said floor engaging portion between a generally upright storage position and an inclined pivotal operating position;

an agitator rotatably mounted in said floor engaging portion and configured for agitating a floor surface being cleaned;

a first motor having an output shaft and an agitator belt selectively drivingly connecting said motor to said agitator;

a tensioning arm pivotally mounted to said floor engaging portion and configured for pivotal motion between an agitator-on position in which said tensioning arm engages said agitator belt, to place said agitator belt under tension whereby said agitator belt drives said agitator, and an agitator-off position in which said tensioning arm does not engage said agitator belt, to place said agitator belt in a slack condition whereby said agitator belt does not drive said agitator;

a spring mounted between said floor engaging portion and said tensioning arm and configured for biasing said tensioning arm into said agitator-on position;

a lifting assembly mounted in said floor engaging portion, said lifting assembly including a second motor and an engaging member driven by said second motor, said engaging member being configured to contact said tensioning arm to selectively place said tensioning arm in said agitator-off position; and an input device provided on said handle portion, said input device including a power button configured to selectively provide power to said vacuum cleaner, a first mode selection button, and a second mode selection button;

wherein said first mode selection button is interconnected to said tensioning arm such that when said first mode selection button is depressed, said tensioning arm is moved toward said agitator-on position; and wherein said second mode selection button is interconnected to said tensioning arm such that when said second mode selection button is depressed, said tensioning arm is moved toward said agitator-off position.

2. A vacuum cleaner according to claim 1, wherein said engaging member comprises a rotatable cam.

3. A vacuum cleaner according to claim 2, wherein said cam is configured to move between a first position and a second position, when in said first position said cam does not contact said tensioning arm, and when in said second position said cam contacts said tensioning arm to apply an upward force to said tensioning arm.

4. A vacuum cleaner according to claim 3, wherein said first position corresponds to said agitator-on position and said second position corresponds to said agitator-off position.

5. A vacuum cleaner according to claim 2, wherein said lifting assembly further comprises a gear box interrelating said second motor to said cam.

6. A vacuum cleaner according to claim 5, wherein said gear box includes an internal gear stop configured to inhibit cam movement beyond the rotational range between said first and said second cam positions.

7. A vacuum cleaner according to claim 2, wherein said cam is configured to rotate on an axis parallel to said surface being cleaned.

8. A vacuum cleaner according to claim 1, wherein said handle portion includes an actuating portion configured to engage said tensioning arm when said handle portion is pivoted from said operating position into said storage position and thereby moves said tensioning arm into said agitator-off position, and configured to disengage said tensioning arm when said handle portion is pivoted from said storage portion into said operating position whereby said spring moves said tensioning arm into said agitator-on position.

9. A vacuum cleaner according to claim 1, further comprising an idler pulley rotatably mounted to said tensioning arm and configured to selectively engage said agitator belt and place said agitator belt under tension.

10. A vacuum cleaner according to claim 1, further comprising a hand grip positioned at the top of said handle portion, said input device provided on said hand grip and configured to cause the vacuum cleaner to operate in at least one predefined operational mode.

11. A vacuum cleaner according to claim 10, wherein said at least one operational mode includes a bare floor mode and said vacuum cleaner configured such that when the vacuum cleaner is in said bare floor mode, said engaging member contacts said tensioning arm to place said tensioning arm in said agitator-off position.

12. A vacuum cleaner according to claim 11, wherein said at least one operational mode further includes a carpet cleaning mode and said vacuum cleaner configured such that when the vacuum cleaner is in said carpet cleaning mode, said engaging member disengages from said tensioning arm to allow said tensioning arm to move to said agitator-on position.

13. A vacuum cleaner according to claim 11, further comprising a microcontroller that receives inputs from said input device and is configured to control the speed of said first motor and the actuation of said second motor.

14. A vacuum cleaner according to claim 1, wherein said input device is configured such that when said first mode selection button is depressed said vacuum cleaner is in a carpet cleaning mode and said lifting assembly does not engage said tensioning arm;

wherein said input device is configured such that when said second mode selection button is depressed said vacuum cleaner is in a bare floor mode and said lifting assembly places said tensioning arm in said agitator-off position; and wherein said input device further includes a third mode selection button, said input device configured such that when said third mode selection button is depressed said vacuum cleaner is in a gentle mode and said lifting assembly does not engage said tensioning arm.

15. A vacuum cleaner according to claim 1 wherein said engaging member comprises a rotatable cylindrical collar having a lip that extends radially about a portion of said cylindrical collar.

16. A vacuum cleaner according to claim 15, wherein said tensioning arm includes a pivot shaft defining a pivot axis about which said tension arm is configured to pivot and a finger extending radially from said pivot shaft, said collar configured to move between a first position and a second position, when in said first position, said lip does not contact said finger and when in said second position, said lip contacts said finger to cause said tensioning arm to rotate.

17. A vacuum cleaner according to claim 16, wherein said first position corresponds to said agitator-on position and said second position corresponds to said agitator-off position.

18. A vacuum cleaner according to claim 1, wherein said input device further includes a third mode selection button;

wherein said input device is configured such that when said first mode selection button is depressed, full power is provided to said first motor;

wherein said input device is configured such that when said second mode selection button is depressed, full power is provided to said first motor; and wherein said input device is configured such that when said third mode selection button is depressed, reduced power is provided to said first motor and said tensioning arm is moved toward said agitator-on position.

19. A vacuum cleaner according to claim 1, wherein said input device is in communication with a microprocessor, and said microprocessor is in electrical communication with said power button, said first mode selection button, and said second mode selection button, and controlling said first motor and said second motor.

20. A vacuum cleaner according to claim 1, wherein said handle portion includes a hand grip, and said input device is located on said hand grip.

21. A vacuum cleaner according to claim 1, wherein said input device is configured such that depression of one of said first mode selection button and said second mode selection button said second motor operates such that said tensioning arm is moved toward one of said agitator-on position and said agitator-off position, respectively.

22. A vacuum cleaner comprising:

a floor engaging portion;

a handle portion pivotally mounted to said floor engaging portion;

an input device provided on said handle portion, said input device including a power button configured to selectively provide power to said vacuum cleaner, a first mode selection button, and a second mode selection button;

an agitator rotatably mounted in said floor engaging portion for agitating a floor surface being cleaned;

a first motor having an output shaft and an agitator belt selectively drivingly connecting said motor to said agitator;

a tensioning arm pivotally mounted to said floor engaging portion for motion between an agitator-on position in which said tensioning arm engages said agitator belt, to place said agitator belt under tension whereby said agitator belt drives said agitator, and an agitator-off position in which said tensioning arm does not engage said agitator belt, to place said agitator belt in a slack condition whereby said agitator belt does not drive said agitator, said tensioning arm being biased toward said agitator-on position; and an engaging member selectively actuated by said input device, said engaging member being adapted to contact said tensioning arm to selectively place said tensioning arm in said agitator-off position;

wherein said input device is configured such that when said first mode selection button is depressed said tensioning arm is moved toward said agitator-on position; and wherein said input device is configured such that when said second mode selection button is depressed said tensioning arm is moved toward said agitator-off position.

23. A vacuum cleaner according to claim 22, wherein said engaging member comprises a rotatable cam.

24. A vacuum cleaner according to claim 23, wherein said cam is configured to move between a first position and a second position, said cam is configured such that when in said first position, said cam does not apply upward force to said tensioning arm and when in said second position, said cam applies an upward force to said tensioning arm.

25. A vacuum cleaner according to claim 24, wherein said first position corresponds to said agitator-on position and said second position corresponds to said agitator-off position.

26. A vacuum cleaner according to claim 22, further comprising a microcontroller configured to receive input signals from said input device and configured to correspondingly control the speed of said first motor and the actuation of said engaging member.

27. A vacuum cleaner according to claim 26, wherein said microcontroller is configured to maintain the vacuum cleaner in one of a plurality of operational modes including a bare floor mode wherein said engaging member contacts said tensioning arm to place said tensioning arm in said agitator-off position.

28. A vacuum cleaner according to claim 27, wherein said at least one operational mode further includes a carpet cleaning mode wherein said engaging member disengages from said tensioning arm to allow said tensioning arm to move to said agitator-on position.

29. A vacuum cleaner according to claim 22, wherein said input device is configured such that when said first mode selection button is depressed said vacuum cleaner is in a carpet cleaning mode and said lifting assembly does not engage said tensioning arm;

wherein said input device is configured such that when said second mode selection button is depressed said vacuum cleaner is in a bare floor mode and said lifting assembly places said tensioning arm in said agitator-off position; and wherein said input device further includes a third mode selection button, said input device configured such that when said third mode selection button is depressed said vacuum cleaner is in a gentle mode and said lifting assembly does not engage said tensioning arm.

30. A vacuum cleaner comprising:

a floor engaging portion;

a handle portion pivotally mounted to said floor engaging portion;

an input device provided on said handle portion, said input device including a power button configured to selectively provide power to said vacuum cleaner, a first mode selection button, and a second mode selection button;

an agitator rotatably mounted in said floor engaging portion for agitating a floor surface being cleaned;

a first motor having an output shaft and an agitator belt selectively drivingly connecting said motor to said agitator;

an arm selectively engaging said agitator belt and mounted to said floor engaging portion for motion between an agitator-on position in which said agitator belt drives said agitator, and an agitator-off position in which said agitator belt does not drive said agitator; and an engaging member responsive to said input device to selectively place said tensioning arm in said agitator-off position;

wherein said input device is configured such that when said first mode selection button is depressed said tensioning arm is moved toward said agitator-on position; and wherein said input device is configured such that when said second mode selection button is depressed said tensioning arm is moved toward said agitator-off position.

* * * * *